United States Patent [19]

Derbyshire

[11] 4,111,079

[45] Sep. 5, 1978

[54] KEYS FOR DRILL CHUCKS

[75] Inventor: George Cecil Derbyshire, Sheffield, England

[73] Assignee: The Jacobs Manufacturing Company, Limited, Sheffield, England

[21] Appl. No.: 797,925

[22] Filed: May 18, 1977

[30] Foreign Application Priority Data

May 28, 1976 [GB] United Kingdom ..... 22430/76

[51] Int. Cl.[2] ..... B25B 13/02

[52] U.S. Cl. ..... 81/90 A; 279/1 K

[58] Field of Search ..... 81/71, 90 A, 121 R, 81/125; 279/1 E, 1 K

[56] References Cited

U.S. PATENT DOCUMENTS

| | | | |
|---|---|---|---|
| 1,798,234 | 3/1931 | Toppin | 81/90 A |
| 2,660,081 | 11/1953 | Dossie | 81/90 A |
| 2,880,008 | 3/1959 | Stoner | 81/90 A X |
| 3,245,446 | 4/1966 | Morifuji | 81/125 X |
| 3,869,943 | 3/1975 | Buck | 81/90 A |
| 3,977,686 | 8/1976 | Buck | 81/90 A X |
| 4,068,978 | 1/1978 | Brock | 81/90 A X |

FOREIGN PATENT DOCUMENTS

| | | | |
|---|---|---|---|
| 825,974 | 12/1959 | United Kingdom | 81/90 A |
| 127,617 | 9/1959 | U.S.S.R. | 81/90 A |

*Primary Examiner*—Al Lawrence Smith
*Assistant Examiner*—James G. Smith
*Attorney, Agent, or Firm*—Stephen J. Rudy

[57] ABSTRACT

A drill chuck key with ejector means for disengaging at least its geared head part or at least its pilot portion from the chuck when released by the user.

6 Claims, 26 Drawing Figures

Figure 9:
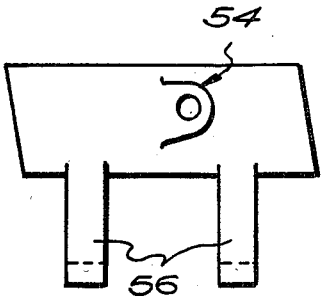
Figure 10:
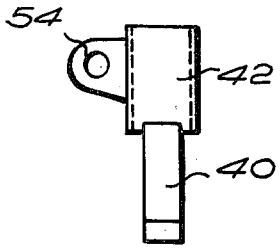

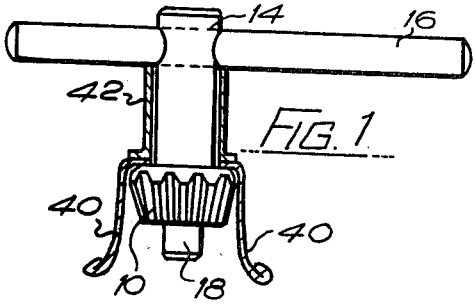
FIG. 1
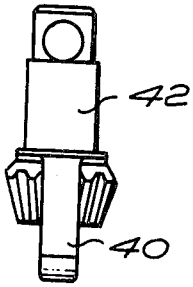
FIG. 2
FIG. 3
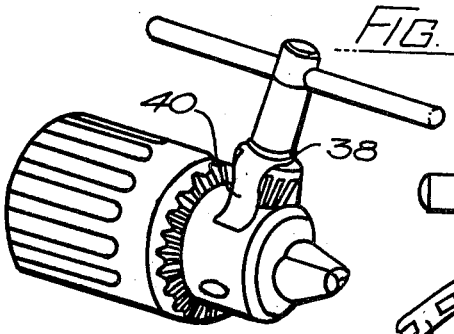
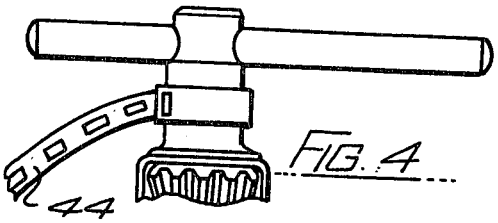
FIG. 4
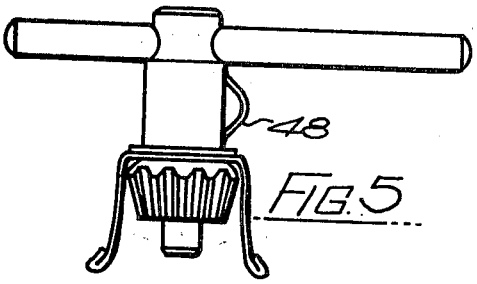
FIG. 5
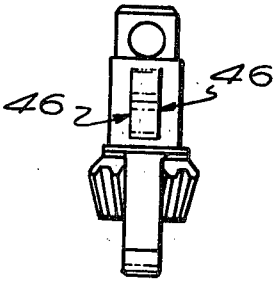
FIG. 6
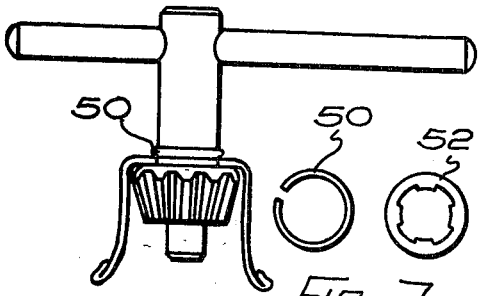
FIG. 7
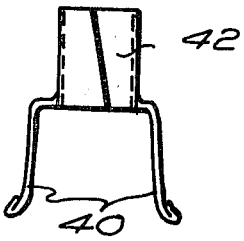
FIG. 8

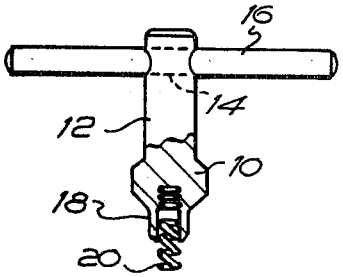
FIG. 21
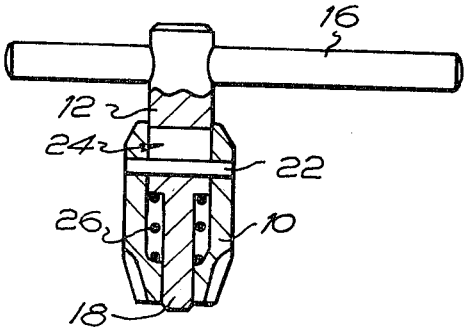
FIG. 22
FIG. 23
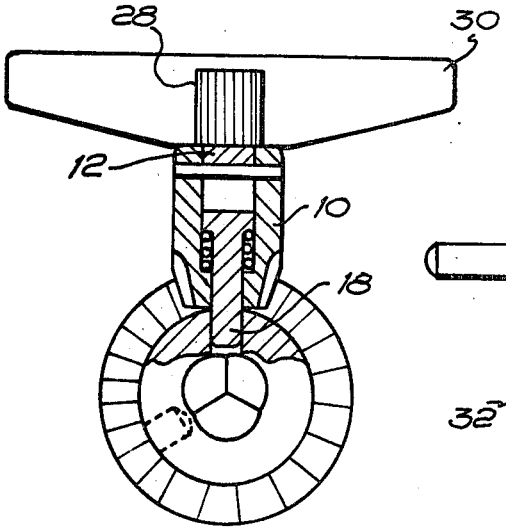
FIG. 24
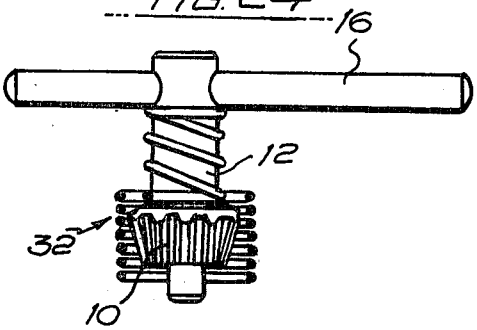
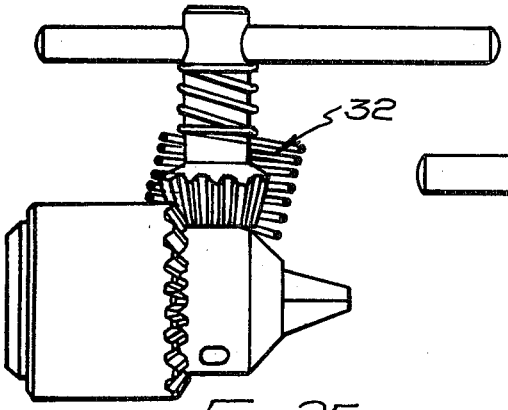
FIG. 25
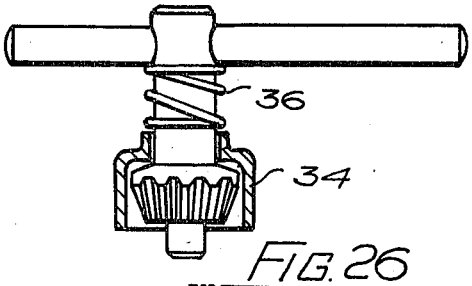
FIG. 26

KEYS FOR DRILL CHUCKS

The invention relates to keys for drill chucks and has for its object to provide an improvement therein.

According to the invention, there is provided a key for a drill chuck, the key being provided with a geared head part and with ejector means whereby at least the toothed portion of the geared head part of the key or at least the pilot portion of the key is disengaged from the chuck when released by the user. The ejector means may be constituted by an element having a pair of resilient limbs arranged to bear against the plain portion of a drill chuck in which the pilot holes are formed, said limbs being splayed out as the key is engaged with the chuck and acting to withdraw the complete key from engagement with the chuck when said key is released by the user. In this case, the element referred to may be a spring steel element formed as a washer-like part with the pair of oppositely disposed resilient limbs formed integrally therewith, and the washer-like part from which the resilient limbs depend may be held in engagement with the geared head part of the key by means of a tubular spacer surrounding a stem part of the key or by means of a circlip engaged in a groove in the stem part. On the other hand, the element referred to may be a synthetic plastics moulded collar provided with integrally formed synthetic plastics resilient limbs arranged to bear against the plain portion of a drill chuck, or provided with spring steel elements constituting the pair of resilient limbs, and the synthetic plastics moulded collar may be provided with an inwardly projecting lip engaged with a groove in a stem part of the key adjacent the geared head.

Alternatively, the ejector means whereby at least the toothed portion or pilot portion of the key is disengaged from the chuck when released by the user may be constituted by a spring extending through said pilot portion or by a spring loaded plunger or pilot portion. As a further alternative, the ejector means may be constituted by a spring or by a spring loaded guard or hood element which surrounds the geared head portion of the key and which is arranged to withdraw the complete key from engagement with the drill chuck when released by the user.

In order that the invention may be fully understood and readily carried into effect, the same will now be described, by way of example only, with reference to the accompanying drawings, of which:

FIGS. 1 and 2 are front and side views of one form of chuck key embodying the invention, and FIG. 3 is a perspective view which shows it in use on a drill chuck, FIG. 4 is a scrap view which will be referred to, FIGS. 5 and 6 are views similar to FIGS. 1 and 2 which illustrate a possible modification, and FIGS. 7 to 26 are views which illustrate further possible modifications.

Referring now to FIGS. 1 to 3, the chuck there illustrated includes a geared head part 10 integral with a stem 12. The stem 12 has a cross bore 14 through which a tommy bar extends. The geared head part 10 is also formed with an integral pilot portion 18 which can be inserted into one of the usual radial holes in the plain diameter of a drill chuck which adjoins the usual geared sleeve or gearnut with which the geared head part of the key is to be engaged.

The chuck key is provided with ejector means constituted by a spring steel element formed as a washer-like part 38 with a pair of oppositely disposed resilient limbs 40. The washer-like part is held in engagement with the geared head part 10 by means of a tubular spacer 42 encircling the stem 12, these two components constituting the ejector means both being freely rotatable on the stem 12 and having been placed in position on the stem before the tommy bar has been fitted. In use, as shown in FIG. 3, the resilient limbs bear against the plain cylindrical portion of the chuck in which the pilot holes are formed and the arrangement is such that the user must hold the key in its engaged position whilst tightening or slackening the chuck. The limbs are splayed out as the key is engaged with the chuck and act to withdraw the complete key from engagement with the chuck when said key is released by the user. In practice, it is almost certain that the user will automatically remove the key and put it safely aside as he feels it being ejected from its operative position as he begins to release his hold.

In FIG. 4 the chuck key just described is shown to be secured on the end of a flexible leash 44 so that it can be connected to a power tool or cable or suitable anchor point. The fact that the leash is connected to the tubular spacer 42 (which as previously mentioned is rotatable on the stem) ensures that the key can be turned without the leash becoming entangled.

In FIGS. 5 and 6 there is illustrated a chuck key which is identical to that previously described with reference to FIGS. 1 and 2 except that in this case the tubular spacer 42 has been slit along two parallel lines 46 and the material between those lines deformed to produce an eyelet 48 for the connection of a leash.

In FIG. 7 there is illustrated a further construction which is very similar to that previously described with reference to FIGS. 1 and 2 except that in this case, instead of being held in engagement with the geared head part by means of a tubular spacer, the washer-like part 38 from which the resilient limbs depend is held in place by means of a circlip 50 engaged in a groove (not shown) in the stem. (However, it will be understood that such a circlip and groove arrangement could be replaced by a spring steel retention device such as that shown at 52 which is capable of gripping a plain stem to resist rearward movement).

In FIG. 8 there is illustrated in side view a spring steel element which has been formed from flat spring steel plate and which could be used instead of the similar spring steel elements and tubular spacers in either of the constructions illustrated in FIGS. 1 to 3, and FIGS. 5 and 6. A developed view of the flat spring steel plate is shown in FIG. 9. A portion of the plate which is to be formed into a tubular spacer 42 is formed with a stamped out tab portion 54 which can be bent outwards as shown in side view in FIG. 10 to form an eyelet for the connection of a leash. Parallel portions 56 of the flat plate become the resilient limbs of the complete spring steel element.

Figure 11:
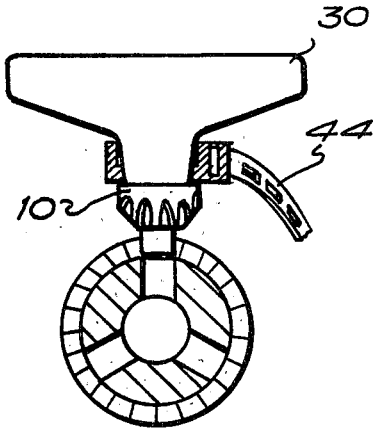
Figure 12:
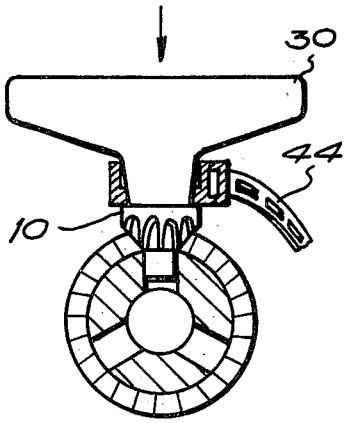
Figure 13:
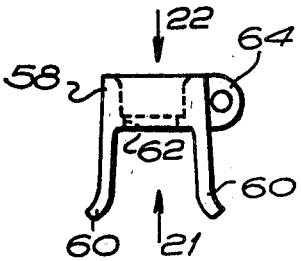
Figure 14:
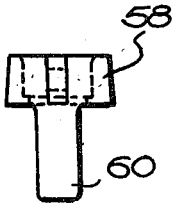
Figure 15:
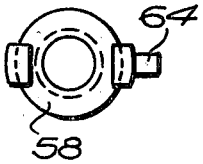
Figure 16:
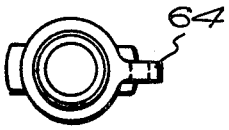

A different construction of ejector means is shown fitted to the chuck key illustrated in FIGS. 11 and 12 (where in FIG. 11 the key is shown in alignment with a pilot hole in a chuck and in FIG. 12 is shown to have been engaged with said pilot hole and with the gear teeth of the chuck). The key in this case is one which includes a geared head part and a handle part 30 of a moulded or die-cast or forged form which has been pressed onto or formed around a stem portion (not shown) of the geared head part. The ejector means are illustrated separately in FIGS. 13 to 16 and are shown to be constituted by a moulded synthetic plastics element having a tubular part 58 from which resilient limbs 60 extend. An inwardly projecting lip 62 has been formed within the tubular part 58 and the arrangement is such that having been pressed over the geared head part of the key, the lip 62 has snapped into position behind the geared head as shown in FIGS. 11 and 12 so that it is retained in position, rotatably, on the key. The tubular part has been moulded integrally with an apertured tab portion 64 which is shown in FIGS. 11 and 12 to have been used for the connection of a flexible leash 44.

The moulded type of ejector means just described and illustrated in FIGS. 13 to 16 could of course be used with a chuck key of the cross handle type and in this case of course could be placed over the stem of the geared head part before the cross handle 16 is fitted in the cross bore. The tubular part could in this case be increased in length to suit the length of the stem, the inwardly projecting lip then being omitted. Alternatively, the inwardly projecting lip 62 could be engaged with a groove in the stem adjacent the geared head.

Figure 17:
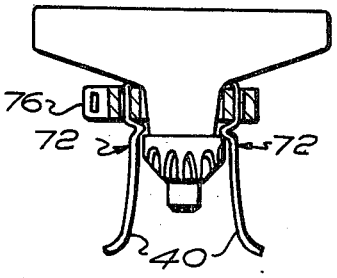
Figure 18:
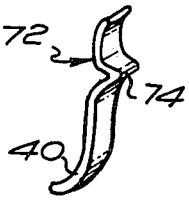
Figure 19:
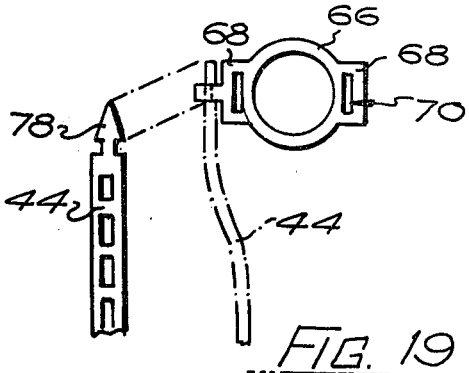

Referring now to FIGS. 17 to 19, these illustrate a composite construction of ejector means shown fitted in FIG. 17 to the kind of chuck key illustrated in FIGS. 11 and 12. The ejector means include a synthetic plastics or die-cast collar 66 (having a bore which can quite easily be passed over the geared head of the key) formed with a pair of diametrically disposed lugs 68 with slots 70 for the reception of respective spring steel elements 72. As best shown in FIG. 18, the spring steel elements 72 are so shaped at their upper ends that they are self-locking in the slots 70 of the collar. The projections 74 intermediate the ends of the elements 72 provide respective stops against the underside of the collar 66 and also snap into place as shown in FIG. 17 behind the geared head of the key. Respective limbs 40 which are formed as parts of the elements 72 then project downwards and outwards for engaging the plain cylindrical nose portion of the drill chuck in the same way as any of the other constructions previously described. The collar 66 is formed with an integral apertured lug 76 for the connection of a flexible leash 44 (which in FIG. 19 is shown to be provided with a plug-in self-retaining end 78).

Figure 20:
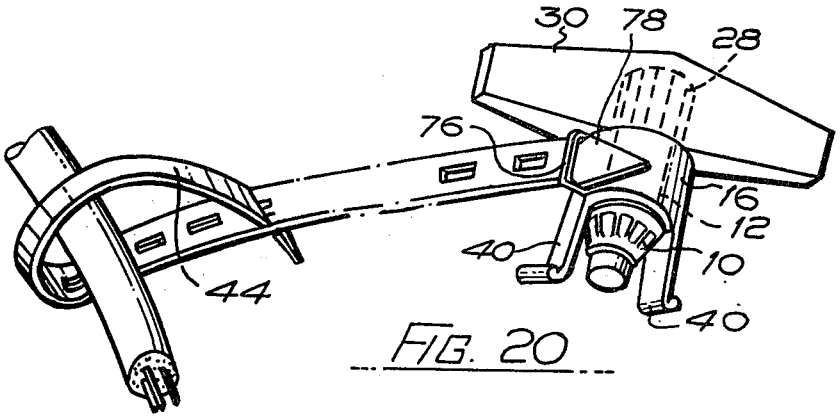

In FIG. 20 there is illustrated a further construction of chuck key provided with ejector means and a flexible leash 44. The chuck key has a geared head part 10 formed integrally with a stem 12 having a serrated end length 28. A plastics handle 30 has been pressed on the stem so that the serrated end length of the latter has cut its way into the inner end of a preformed cylindrical aperture in the handle.

The ejector means have been fitted on a spigot portion of the handle before the geared head and handle parts have been united together. The ejector means are constituted by a plastics moulded collar 66 and integrally moulded resilient limbs 40. The collar 66 is also provided with an integral apertured lug 76 in which a plug-in self-retaining end 78 of the flexible leash 44 is shown to be retained (the other end of the leash being capable of being looped around the cable of a powered hand tool, as shown, or if the key is to be used with a bench drill it may be desired to increase the overall length of the leash in which case two such leashes could be connected together end to end, each one being interengaged with the other).

Referring now to FIG. 21, the chuck key there illustrated is again of well known construction (being provided with a geared head part 10 integral with a stem 12, and having a tommy bar extending through a cross bore 14 in the stem) except that the integral pilot portion 18 has been provided with a blind hole, as shown, and a compression spring 10 is shown to have been entered into said hole and to have been engaged with a screwthreaded portion at the inner end of said hole. In its free condition, as shown, the spring projects beyond the end of the pilot portion.

The arrangement is such that when the user wishes to engage the key with a chuck, he must compress the spring 20 to bring the geared head part into driving engagement with the usual geared sleeve or gearnut of the chuck and must hold the key in its engaged position whilst tightening or slackening the chuck. When he releases the key, it it automatically ejected from its operative position by the spring.

Referring now to FIG. 22, in a rather different construction of chuck key the geared head part 10 is provided with a spring-loaded pilot portion 18 which has been formed integrally with the stem 12 (the upper portion of which is provided with a cross bore through which the tommy bar 16 extends). The geared head part 10 is slidably mounted on the stem 12 through a distance determined by the sliding of a pin 22 along a slot 24 in the stem. The pin 22 provides the driving connection by which a torque can be applied to the geared head part by the stem 12.

The arrangement is such that when the user wishes to engage the key with a chuck he must compress the spring 26 to engage the pilot portion 18 in the pilot hole of the chuck and must hold the pilot portion in its engaged position whilst tightening or slackening the chuck. When he releases the key, the pilot portion is automatically ejected from the pilot hole in the chuck by the spring 26 so that the key can then fall away completely from the chuck. (The continued engagement of the gear teeth alone would not be sufficient to hold the key in position on the chuck due to the weight of the key).

The construction of key illustrated in FIG. 23 is very similar to that just described with reference to FIG. 22 except that in this case, instead of being provided with a cross bore for the reception of a tommy bar, the stem 12 is provided with a serrated end length 28 on which has been pressed a plastics, die-cast or forged handle 30.

In FIG. 24 there is illustrated a chuck key provided with ejector means constituted simply by a spring 32, said spring having a close coiled guard portion encircling the geared head part 10 and a smaller diameter more open coiled portion encircling the stem 12. The key is of course of otherwise quite conventional construction and it will be understood that the spring has been placed in position around the geared head portion and stem before the tommy bar 16 has been fitted through the cross bore in the stem. The chuck key is shown in FIG. 25 in engagement with a drill chuck and it will be noted how the guard portion of the spring tilts to accommodate itself properly against the chuck as it is compressed. The spring acts in this case to withdraw the complete key from engagement with the drill chuck when the key is released by the user.

In FIG. 26 there is shown a construction of chuck key very similar to that just described with reference to FIGS. 24 and 25 except that the ejector means are constituted in this case by a guard portion or hood 34 which is slidably disposed on the stem 12 and spring loaded by a spring 36 encircling the stem. The chuck key acts in the same way as that described with reference to FIGS. 24 and 25 except that the guard portion or hood 34 cannot tilt in the same way as the close coiled guard portion of the spring 32.

Various other constructions and modifications may be made without departing from the scope of the invention and it will be observed that although for example those constructions described with reference to FIG. 20, FIG. 21, FIG. 22 and FIG. 23 are entirely new constructions of key, those described in for example any of FIGS. 1 to 6 and FIGS. 24 to 26 are keys of well known construction fitted with ejector means during their assembly. On the other hand, the ejector means illustrated for example in FIGS. 11 to 16 and in FIGS. 17 to 19 can be regarded as being an accessory and can be fitted to an existing key at any time.

What I claim and desire to secure by Letters Patent is:

1. In a drill chuck key having a geared head part and a pilot part, an ejector means for disengaging the key from a drill chuck when axial pressure on the key is released, in which said ejector means is constituted by an element having a pair of resilient limbs arranged to bear against the plain portion of a drill chuck in which the pilot holes are formed, said limbs being splayed out as the key is engaged with the chuck and acting to withdraw the complete key from engagement with the chuck when said key is released by the user.

2. A key according to claim 1, in which the ejector means are constituted by a spring steel element formed as a washer-like part with the pair of oppositely disposed resilient limbs formed integrally therewith.

3. A key according to claim 2, in which the washer-like part from which the resilient limbs depend is held in engagement with the geared head part of the key by means of a tubular spacer surrounding a stem part of the key.

4. A key according to claim 2, in which the washer-like part from which the resilient limbs depend is held in engagement with the geared head part by means of a circlip engaged in a groove in a stem part of the key.

5. A key according to claim 1, in which the ejector means are constituted by a synthetic plastics moulded collar provided with integrally formed synthetic plastics resilient limbs arranged to bear against the plain portion of a drill chuck.

6. A key according to claim 1, in which the ejector means are constituted by a synthetic plastics moulded collar provided with spring steel elements constituting the pair of resilient limbs.

* * * * *